US008985701B2

(12) United States Patent
Denson et al.

(10) Patent No.: US 8,985,701 B2
(45) Date of Patent: Mar. 24, 2015

(54) COLD PLANER HAVING MULTI-INLET EXHAUST SYSTEM

(75) Inventors: David M. Denson, Chennai (IN); Apurv A. Patel, Gandhinagar (IN); Kevin G. Turnquist, Blaine, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 21 days.

(21) Appl. No.: 13/547,498

(22) Filed: Jul. 12, 2012

(65) Prior Publication Data

US 2014/0015303 A1 Jan. 16, 2014

(51) Int. Cl.
*E01C 23/088* (2006.01)
*E01C 23/12* (2006.01)

(52) U.S. Cl.
CPC ..... *E01C 23/088* (2013.01); *E01C 23/127* (2013.01); *E01C 2301/50* (2013.01)
USPC ..... 299/39.2; 299/39.4

(58) Field of Classification Search
CPC ..... E01C 2301/50
USPC ..... 299/36.1, 39.1, 39.2, 39.4
See application file for complete search history.

(56) References Cited

U.S. PATENT DOCUMENTS 4,784,755 A 11/1988 Taylor
5,021,149 A 6/1991 Geisseler
5,492,431 A * 2/1996 Rasmussen et al. ..... 404/75
6,733,086 B1 5/2004 McSharry et al.
7,175,364 B2 2/2007 Gaertner et al.
7,219,964 B2 5/2007 Berning et al.
7,422,390 B2 9/2008 Gaertner et al.
2007/0122236 A1 5/2007 Gaertner et al.
2009/0267402 A1 * 10/2009 Berning et al. ..... 299/39.4
2010/0327651 A1 * 12/2010 Cipriani ..... 299/39.2
2011/0272511 A1 * 11/2011 Hall et al. ..... 241/101.2

FOREIGN PATENT DOCUMENTS

EP 971075 A1 * 1/2000

* cited by examiner

*Primary Examiner* — David Bagnell
*Assistant Examiner* — Michael Goodwin
(74) *Attorney, Agent, or Firm* — Finnegan, Henderson, Farabow, Garrett & Dunner, LLP

(57) ABSTRACT

An exhaust system is disclosed for use with a cold planer. The exhaust system may have an inlet manifold located downstream of a milling drum and above a material conveyor. The inlet manifold may be configured to receive dust and fumes generated by the milling drum. The exhaust system may also include at least one inlet passage located at a side of the material conveyor and gravitationally lower than the inlet manifold. The at least one inlet passage may be configured to receive dust and fumes generated by the milling drum. The exhaust system may further include a ventilator in fluid communication with the inlet manifold and the at least one inlet passage. The ventilator may be configured to draw the dust and fumes from the inlet manifold and the at least one inlet passage.

27 Claims, 4 Drawing Sheets

COLD PLANER HAVING MULTI-INLET EXHAUST SYSTEM

TECHNICAL FIELD

The present disclosure relates generally to a cold planer and, more particularly, to a cold planer having a multi-inlet exhaust system.

BACKGROUND

Asphalt-surfaced roadways have been built to facilitate vehicular travel. Depending upon usage density, base conditions, temperature variation, moisture variation, and/or physical age, the surface of the roadways can eventually become misshapen, non-planar, unable to support wheel loads, or otherwise unsuitable for vehicular traffic. In order to rehabilitate the roadways for continued vehicular use, spent asphalt is removed in preparation for resurfacing.

Cold planers, sometimes also called road mills or scarifiers, are machines that typically include a frame quadrilaterally supported by tracked or wheeled drive units. The frame supports an engine, an operator's station, and a milling drum. The milling drum, fitted with cutting tools, is rotated through a suitable interface by the engine to break up the surface of the roadway.

During the milling process, dust is produced by the cutting tools that can be a nuisance to machine operators. In addition, bituminous vapors may be produced due to high temperature friction of the cutting tools.

One attempt to control the dust and vapors produced during roadway milling is disclosed in U.S. Pre-Grant Publication No. US 2010/0327651 ("the '651 publication"), published on Dec. 30, 2010, and submitted by Cipriani et al. In particular, the '651 publication discloses a means of sealing the dust and vapors produced during the milling process from exiting the milling machine prior to the point of discharge of the milled road material. The sealing means create a continuous chamber above material conveyors and in a joint connection area among them. The continuous chamber is designed to be free from external air channels and is formed by sidewalls of the milling drum housing, a rear mouldboard and side plates. A suction device is located on the milling machine and connected to the continuous chamber. The suction device is able to create a depression that draws dust and polluted air from the continuous chamber, and routes the same to a filtering and discharge system.

Although the system of the '651 publication may be capable of controlling dust and fumes generated during the roadway milling process, the system may still be problematic. In particular, an efficiency of the suction device is dependent upon the continuous chamber being well-sealed. As it is presently constituted, the sealing means of the '652 publication includes a multitude of components. Given the number of sealing components associated with the continuous chamber it is likely that gaps in the sealing means will arise overtime. In addition, on account of the number of components involved and the degree of customization of the components specific to a unique milling machine model, it is unlikely that the suction system of the '652 publication could easily be applied and/or retrofitted to other models of milling machines.

The cold planer and exhaust system of the present disclosure solves one or more of the problems set forth above and/or other problems in the art.

SUMMARY

In one aspect, the present disclosure relates to an exhaust system for a cold planer. The exhaust system may include an inlet manifold located downstream of a milling drum and above a material conveyor. The inlet manifold may be configured to receive dust and fumes generated by the milling drum. The exhaust system may also include at least one inlet passage located at a side of the material conveyor and gravitationally lower than the inlet manifold. The at least one inlet passage may be configured to receive dust and fumes generated by the milling drum. The exhaust system may further include a ventilator in fluid communication with the inlet manifold and the at least one inlet passage. The ventilator may be configured to draw the dust and fumes from the inlet manifold and the at least one inlet passage.

In an other aspect, the present disclosure may be related to an other exhaust system for a cold planer. This exhaust system may include an inlet manifold located downstream of a milling drum and above a first material conveyor. The inlet manifold may be configured to receive dust and fumes generated by the milling drum. The exhaust system may also include at least one inlet passage located at a transition area between the first material conveyor and a second material conveyor. The at least one inlet passage may be configured to receive dust and fumes generated by the milling drum. The exhaust system may further include a ventilator in fluid communication with the inlet manifold and the at least one inlet passage. The ventilator may be located at a discharge end of the second material conveyor and configured to draw the dust and fumes from the inlet manifold and from the at least one inlet passage.

DETAILED DESCRIPTION

For the purpose of this disclosure, the term "asphalt" may be defined as a mixture of aggregate and asphalt cement. Asphalt cement may be a brownish-black solid or semi-solid mixture of bitumens obtained as a byproduct of petroleum distillation. The asphalt cement may be heated and mixed with the aggregate for use in paving roadway surfaces, where the mixture hardens upon cooling. A "cold planer" may be defined as a machine used to remove layers of hardened asphalt from an existing roadway. It is contemplated that the disclosed cold planer may also or alternatively be used to remove cement and other roadway surfaces.

Figure 1:
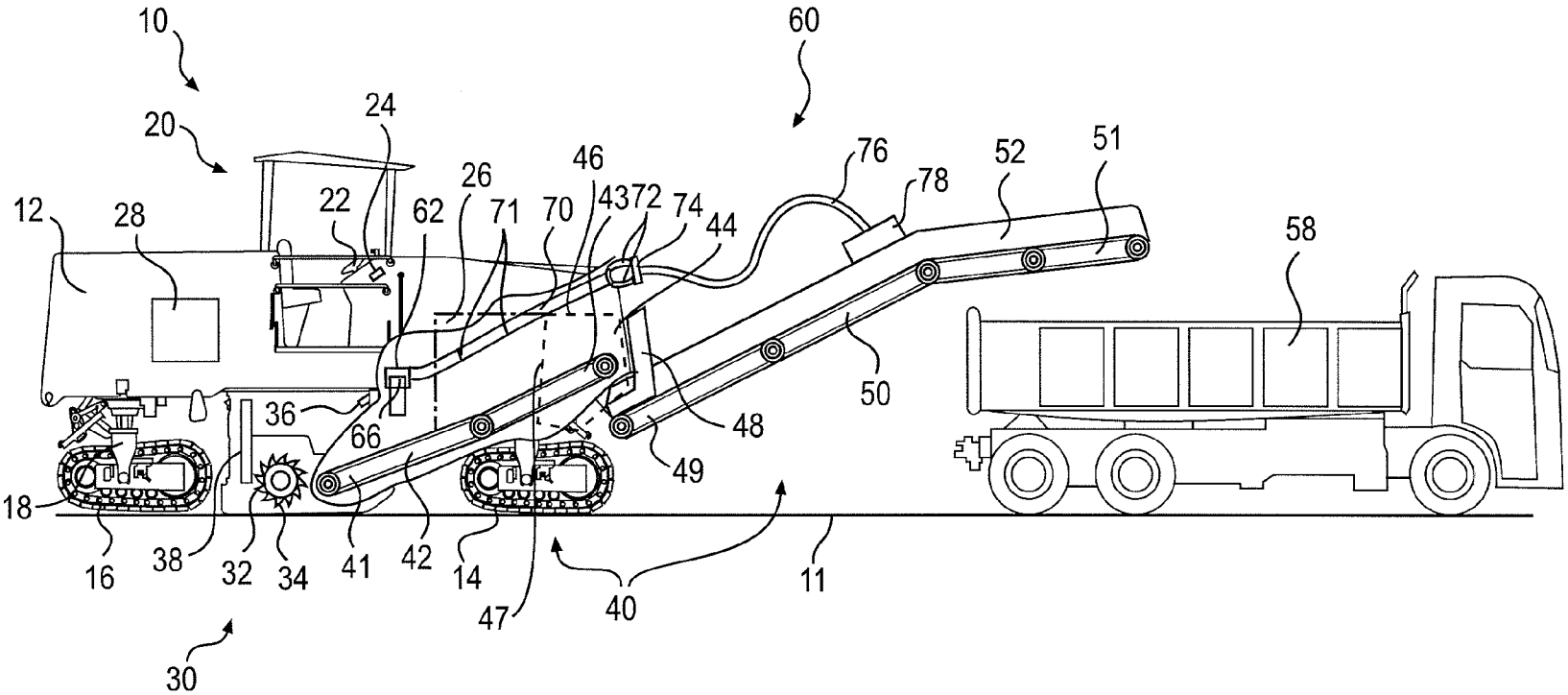
FIG. 1 is a partial cross-sectional illustration of an exemplary disclosed cold planer.

FIG. 1 illustrates an exemplary cold planer 10 having an exhaust system 60. Exhaust system 60 may be attachably integrated with a milling system 30 and a debris removal system 40 of cold planer 10. It is contemplated that exhaust system 60 may be integrated with additional components and systems within cold planer 10, if desired, such as an auxiliary power system (not shown).

Cold planer 10 of FIG. 1 may include a frame 12 supported by one or more front ground engaging units 14 and one or more rear ground engaging units 16. Ground engaging units 14 and 16 may each include either a wheel or a track section that is pivotable in one or more directions. Ground engaging units 14 and/or 16 may be connected to lifting columns 18, which may be adapted to controllably raise and lower frame 12 relative to the associated ground engaging units 14 and 16.

Frame 12 may support an operator's station 20 having a steering command element 22 and a controller 24. Steering command element 22 is shown to include a steering wheel, but other steering devices such as a joystick or levers could be used as well. Controller 24 may send control signals to one or more actuators (not shown) of the following: ground engaging units 16 and 18, lifting columns 18, milling system 30, debris removal system 40 and exhaust system 60. In the case of electrically activated actuators, the control signals may act directly on the respective actuators. In the case of hydraulically activated actuators, the control signals may act on valves, which in turn control flows of pressurized fluid to the actuators. Controller 24 may be a separate control unit or may be part of a central control unit operable to control additional functions of cold planer 10.

Frame 12 may also support a water tank 26, an engine 28 such as an internal combustion engine, and milling system 30. Engine 28 may supply power to drive one or more of ground engaging units 14 and 16 to propel cold planer 10 relative to a road surface 11. In one embodiment, this is accomplished by driving a hydraulic pump with an output of engine 28, which in turn supplies high-pressure hydraulic fluid to individual motors associated with ground engaging units 14 and 16. This conventional hydraulic drive is well-known in the pertinent art and is therefore not depicted in the drawings. Engine 28 may also supply power to milling system 30 to break up road surface 11.

Milling system 30 may include various components that interact to remove asphalt from roadway surface 11. Specifically, milling system 30 may include a milling drum 32, a plurality of cutting tools 34, a water nozzle 36 and a milling drum housing 38. Cutting tools 34 may be attached to milling drum 32 in any manner known in the art. During the milling process, cutting tools 34 may be frictionally heated on account of their sustained contact with roadway surface 11. Water nozzle 36 may spray water on milling drum 32 and its associated cutting tools 34 during the operation of milling system 30 to cool the same. Milling system 30 may be configured to remove a layer of asphalt from the entire width of roadway surface 11 or from only a portion of roadway surface 11 at varying depths and contours. The broken-up road material may be carried away from cold planer 10 by debris removal system 40.

Debris removal system 40 may include various components that cooperate to remove milled asphalt from milling system 30. Specifically, debris removal system 40 may include a primary conveyor 42, a secondary conveyor 50, and a transition area 44 located between primary conveyor 42 and secondary conveyor 50. Cutting tools 34 may be configured to deliver milled asphalt onto a charge end 41 of primary conveyor 42 as milling drum 32 rotates towards primary conveyor 42. As the milled asphalt exits a discharge end 43 of primary conveyor 42, the milled asphalt may strike against a weldment 48 located within transition area 44. Transition area 44 may be an enclosed box-like structure formed by a cover plate 46, and two or more side plates 47. Upon coming into forced contact with weldment 48, the milled asphalt may break apart and fall onto a charge end 49 of secondary conveyor 50. The milled asphalt, being transported by secondary conveyor 50, may be kept from exiting secondary conveyor 50 prematurely (i.e., kept from spilling off the sides) by a secondary conveyor housing 52. Secondary conveyor 50 may discharge the milled asphalt at a discharge end 51. The milled asphalt may be off-loaded to any appropriate transport vehicle 58, such as an on-highway haul truck, an off-highway articulated or non-articulated truck, or any other type of transport vehicle known in the art. In the disclosed embodiment, secondary conveyor 50 may need to move somewhat relative to primary conveyor 42. For example, secondary conveyor 50 may need to move in side-to-side and/or up-and-down motions as it facilitates the discharge of milled asphalt to a moving transport vehicle 58.

During the milling process, dust may be produced on account of the breaking up of road surface 11. In particular, relatively large quantities of dust may be produced at milling drum 32, and when the milled asphalt is further broken down by coming into contact with weldment 48 in transition area 44. Bituminous vapors may also be produced due to high temperatures created by the friction of cutting tools 34 against road surface 11. Exhaust system 60 may be attachably integrated with milling system 30 and debris removal system 40 to help control the dust and fumes generated during operation of cold planer 10.

Figure 2:
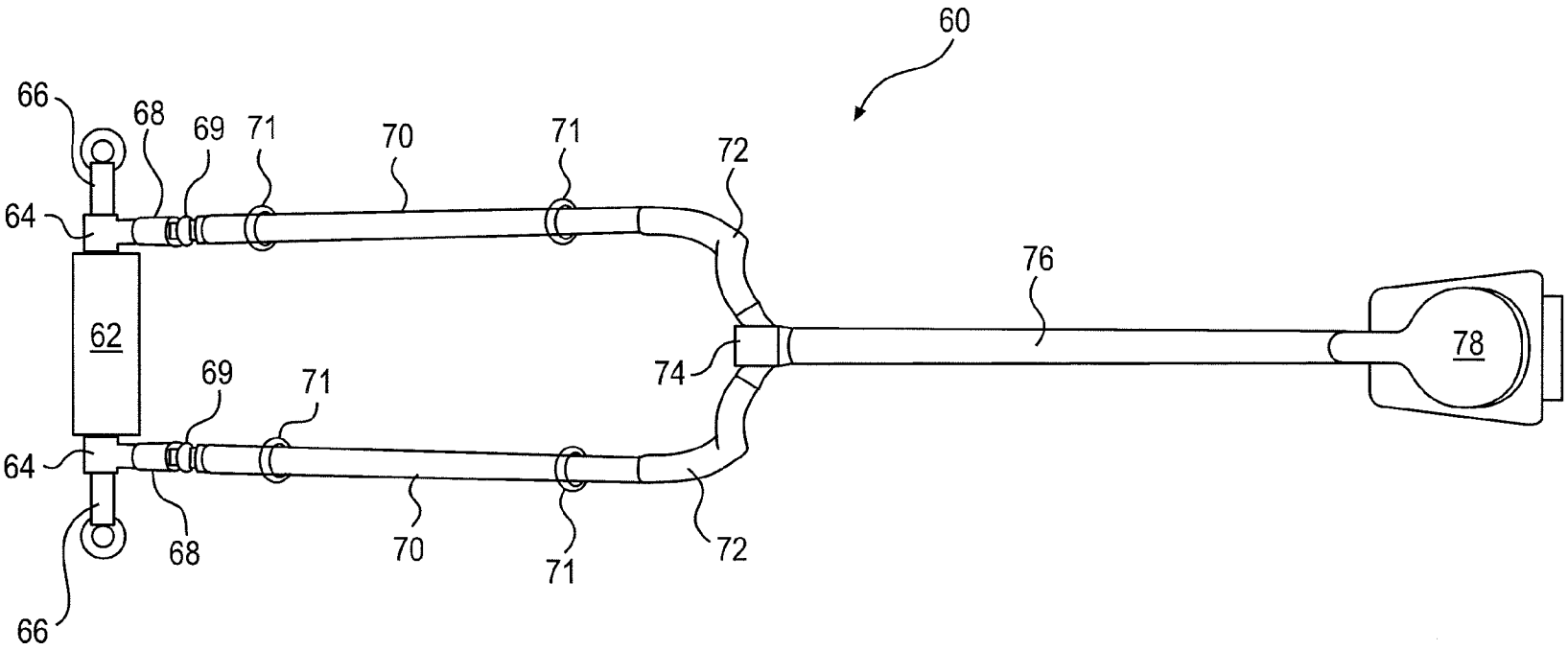
FIG. 2 is a pictorial illustration of an exemplary disclosed exhaust system that may be used in conjunction with the cold planer of FIG. 1.

As illustrated in FIGS. 1 and 2, exhaust system 60 may include various components that cooperate to remove dust and fumes during the operation of cold planer 10. Specifically, exhaust system 60 may include an inlet manifold 62, at least two inlet extensions 66, and at least two inlet connectors 64. Inlet manifold 62 may be an elongated steel fabricated hood connected to inlet extensions 66 at opposing ends by inlet connectors 64. Inlet manifold 62 and inlet extensions 66 may each have openings through which dust and fumes are drawn into exhaust system 60. In one exemplary embodiment, inlet manifold 62 may be placed directly above primary conveyor 42 (referring to FIG. 1), with inlet extensions 66 oriented to the sides of primary conveyor 42. In one embodiment, inlet extensions 66 may be gravitationally lower than inlet manifold 62, extending downward to the lateral sides of primary conveyor 42. Inlet extensions 66 may extend to a point at which they are likely to draw in a desired amount of dust and fumes, but unlikely to draw in larger fragments of milled material. Both inlet manifold 62 and inlet extensions 66 may be placed downstream of milling drum 32. In one exemplary embodiment, inlet manifold 62 and inlet extensions 66 may be placed at about 300-800 mm downstream of milling drum 32 so as to avoid drawing in larger fragments of milled material thrown into the air by cutting tools 34. Dust and fumes generated by milling system 30 may be routed to inlet manifold 62 and inlet extensions 66 via suction produced by a ventilator 78.

Dust and fumes collected at inlet manifold 62 and inlet extensions 66 may be drawn through an arrangement of pipes and flexible tubes and/or hoses to ventilator 78, where the collected dust and fumes may be delivered to secondary conveyor 50 within secondary conveyor housing 52. As illustrated in FIG. 2, the arrangement of pipes and flexible tubes of exhaust system 60 may include, among other things, a plurality of flexible fittings 68, a plurality of rigid pipes 70, first and second flexible hoses 72 and 76, and a junction 74. Flexible fittings 68 may be fabricated from an elastomer, for example rubber, and connected at one end to inlet connectors 64 and at an opposing end, (i.e., at connection 69), to rigid pipes 70. Rigid pipes 70 may be connected to flexible hoses 72, and run generally parallel to primary conveyor 42 with one rigid pipe 70 located at each side of water tank 26. Junction 74 may receive the combined air flow of flexible hoses 72 and route the same to flexible hose 76. In one exemplary embodiment, rubber fittings 68, connections 69, rigid tubes 70 and flexible hoses 72 may be between about 3-5 inches in diameter, and flexible hose 76 may be between about 7-9 inches in diameter. Flexible hose 76 may connect junction 74 to ventilator 78. Certain components of exhaust system 60 (e.g., flexible fittings 68, flexible hoses 72 and flexible hoses 76) may need to be flexible so as to be able to move with the up-and-down and side-to-side motions of secondary conveyor 50.

Ventilator 78 may create a depression within exhaust system 60, such that the air pressure outside inlet manifold 62 and inlet extensions 66 is greater than the air pressure within exhaust system 60. Consequently, dust and polluted air generated from the operation of milling system 30 may be drawn in and routed through exhaust system 60 to secondary conveyor 50 within secondary conveyor housing 52. In one embodiment, ventilator 78 may have a cast aluminum fan wheel disposed within a steel fan housing, and may be powered by a hydraulic motor (not shown).

In one exemplary embodiment, exhaust system 60 may be removably attached to cold planer 10 at one or more attachment points 71, as shown in FIG. 1. Attachment points 71 may include any number of various rigid, elastic or plastic types of fasteners, clamps, joints, links, couplings or other mechanical attachment mechanisms. In one exemplary embodiment, attachments 71 may connect rigid pipes 70 to water tank 26 and ventilator 78 to secondary conveyor housing 52. As rigid pipes 70 may be removably attached to the exterior of water tank 26, as opposed to running through water tank 26, exhaust system 60 may be easily removed from cold planer 10. Upon removal of exhaust system 60 from cold planer 10, the insertion points of exhaust system 60 (e.g. where the airway of ventilator 78 may enter into secondary conveyor housing 52) may be plugged by any number of various different types of plugs, caps, fillers, fittings or stoppers.

Figure 3:
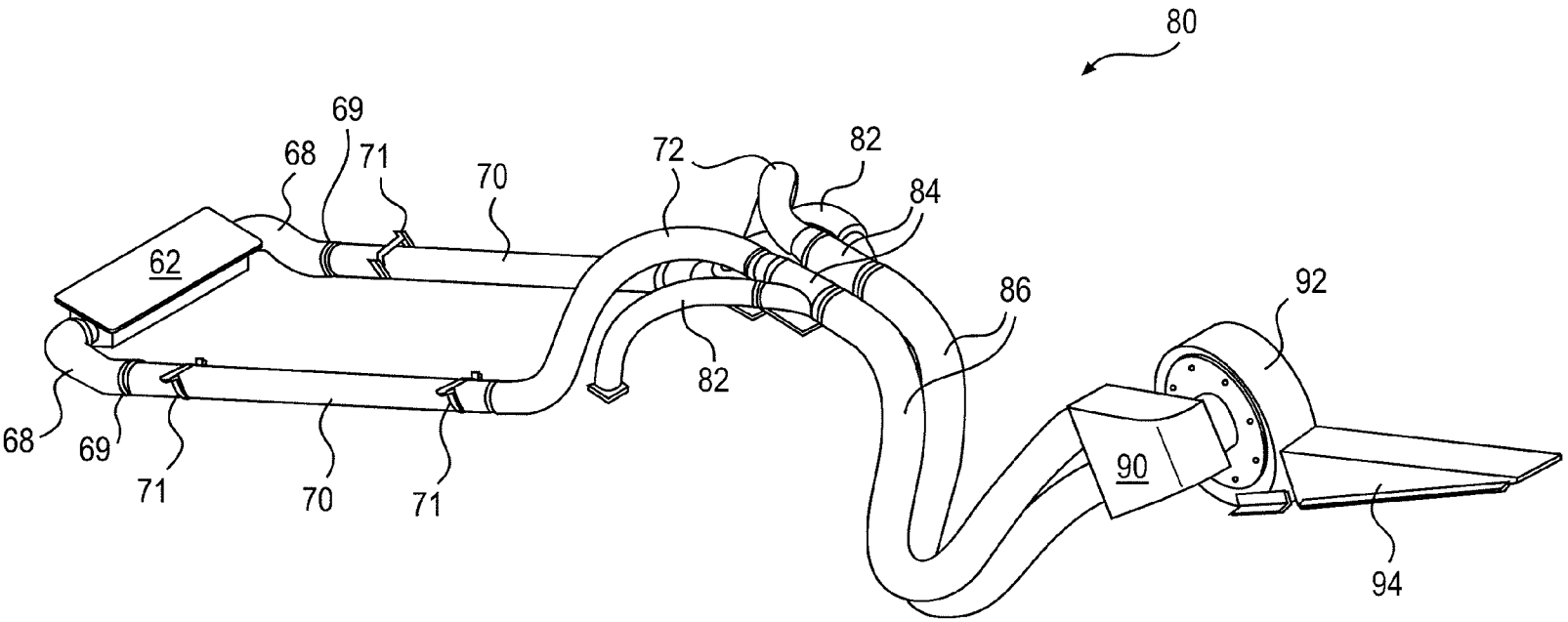
FIG. 3 is a pictorial illustration of an alternative embodiment of an exemplary disclosed exhaust system that may be used in conjunction with the cold planer of FIG. 1.

An alternative exhaust system 80 is shown in FIG. 3. Like exhaust system 60 of FIG. 2, exhaust system 80 of FIG. 3 may include inlet manifold 62, flexible fitting 68, rigid pipes 70, attachment points 71, and flexible hose 72. In contrast to exhaust system 60, however, exhaust system 80 may omit inlet extensions 66. Instead, exhaust system 80 may include secondary inlet hoses 82 that, in one exemplary embodiment, may be associated with transition area 44. Both inlet manifold 62 and secondary inlet hoses 82 may be placed downstream of milling drum 32. In one exemplary embodiment, inlet manifold 62 may be placed at about 300-800 mm downstream of milling drum 32, and secondary inlet hoses 82 may be inserted into transition area 44 at about 300-800 mm upstream of weldment 48 so as to avoid drawing in larger fragments of milled material. Dust and fumes generated by milling system 30 and at weldment 48 may be routed to inlet manifold 62 and secondary inlet hoses 82, respectively, via suction produced by a ventilator 92.

Dust and fumes collected at inlet manifold 62 and secondary inlet hoses 82 may be drawn through an arrangement of pipes and flexible tubes and/or hoses to ventilator 92, where the collected dust and fumes may be delivered to secondary conveyor 50 within secondary conveyor housing 52. Like exhaust system 60 of FIG. 2, exhaust system 80 of FIG. 3 may include flexible fitting 68, connection 69, rigid pipes 70, attachment points 71, and flexible hoses 72. In contrast to exhaust system 60, exhaust system 80 may also include hose connectors 84 and flexible hoses 86. Flexible fittings 68 may be fabricated from an elastomer, for example rubber, and connected on one end to inlet manifold 62 and on an opposing end (i.e., at connection 69), to rigid tubes 70. Rigid tubes 70 may be connected to flexible hoses 72 and run generally parallel to primary conveyor 42, with one tube located on each side of water tank 26. Hose connectors 84 may receive the combined air flow of flexible hoses 72 and secondary inlet hoses 82 and route the same to flexible hoses 86. In one exemplary embodiment, rubber fittings 68, connections 69, rigid tubes 70 and flexible hoses 72 may be between about 3-5 inches in diameter, secondary inlet hoses 82 may be between 2-4 inches in diameter, and flexible hoses 86 may be between about 4-6 inches in diameter. Flexible hoses 86 may deliver the collected dust and fumes to ventilator 92 via ventilator inlet manifold 90.

As is also illustrated in FIG. 3, exhaust system 80 may further include a ventilator inlet manifold 90, ventilator 92 and ventilator exhaust duct 94. Ventilator 92 may create a depression within exhaust system 80 such that the air pressure outside inlet manifold 62 and secondary inlet hoses 82 is greater than the air pressure within exhaust system 80. Consequently, dust and polluted air generated from the operation of milling system 30 and at weldment 48 may be drawn in and routed through exhaust system 80 to secondary conveyor 50 within secondary conveyor housing 52. Ventilator exhaust duct 94 may provide a channel whereby the polluted air may enter into secondary conveyor housing 52 from ventilator 92. In one exemplary embodiment, ventilator 92 may have a cast aluminum fan wheel disposed within a radial steel fan housing, may be powered by a hydraulic motor, and ventilator exhaust duct 94 may extend about 1,000-1,200 mm along secondary conveyor housing 52 so as to maintain a desired air flow through ventilator 92. The cut-off of exhaust duct 94 may occur prior to a mid-point or folding-point of secondary conveyor 50 for purposes related to transport and shipping of cold planer 10.

Exhaust system 80 may be removably attached to cold planer 10 at attachment points 71. In particular, attachments 71 may connect rigid pipes 70 to water tank 26 and ventilator 92 to secondary conveyor housing 52. As rigid pipes 70 may be removably attached to the exterior of water tank 26, as opposed to running through water tank 26, exhaust system 80 may be easily removed from cold planer 10. Upon removal of exhaust system 80 from cold planer 10, the insertion points of exhaust system 60 (e.g. where the airway of ventilator 78 may enter into secondary conveyor housing 52) may be plugged by any number of various different types of plugs, caps, fillers, fittings or stoppers.

Figure 4:
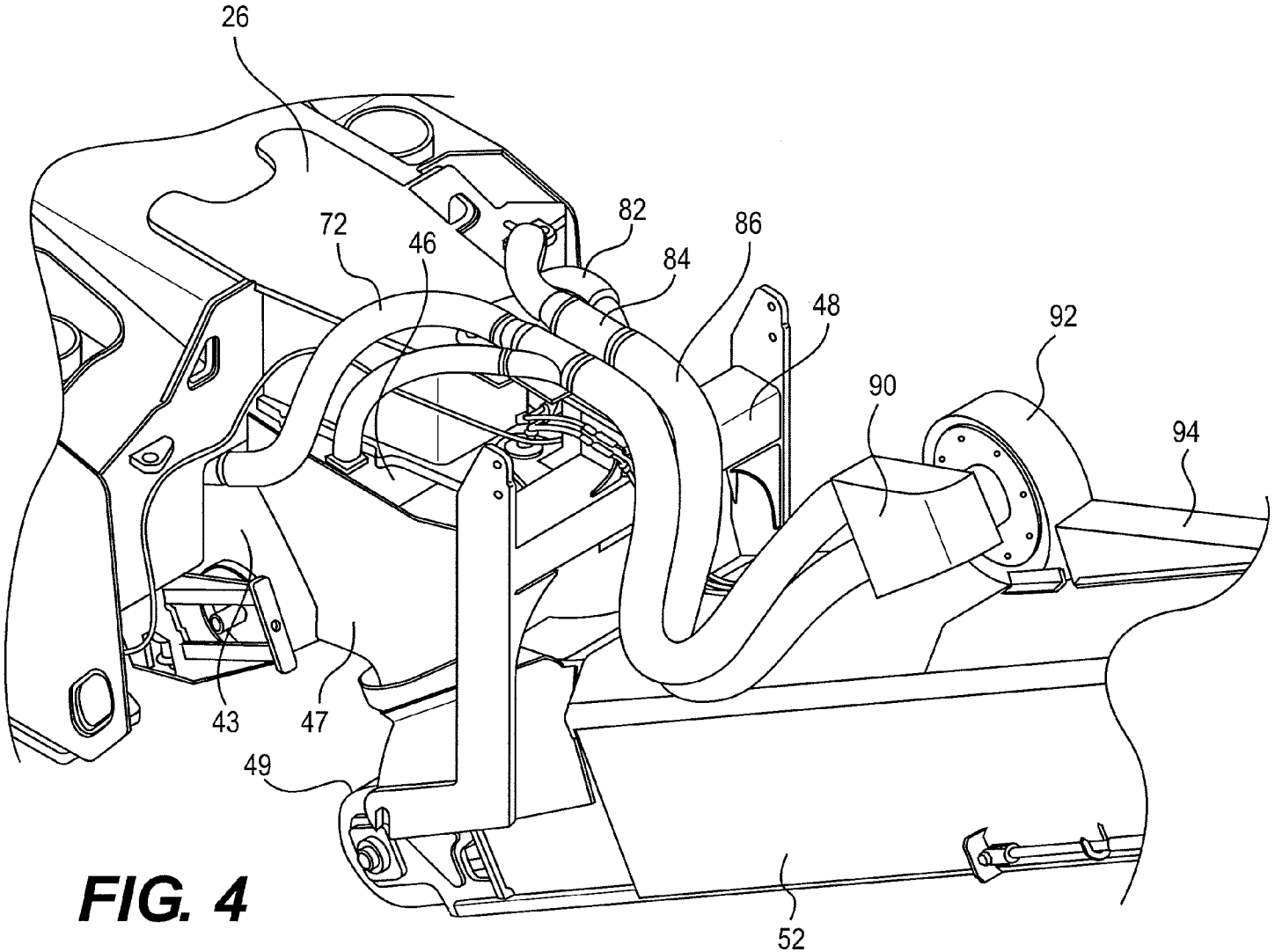
FIG. 4 is an enlarged pictorial illustration of a portion of the exhaust system of FIG. 3.

FIG. 4 illustrates exhaust system 80 attached to cold planer 10. As illustrated in FIG. 4, ventilator 92 and ventilator exhaust duct 94 are attached to the topside of secondary conveyor housing 52. Secondary inlet hoses 82 enter transition area 44 upstream of weldment 48 at opposing sides of transition area 44. Flexible hoses 72, 82, and 86 are not themselves attached directly to cold planer 10, thereby allowing secondary conveyor 50 to move freely from side to side as well as up and down relative to primary conveyor 50 and frame 12.

INDUSTRIAL APPLICABILITY

The disclosed exhaust systems may be used with any road material or asphalt removal system where control of milling-generated dust and fumes is desired. The disclosed exhaust systems may help to prevent the egress of dust and fumes from cold planer 10 by routing the dust and fumes to secondary conveyor 50, from which they can be off-loaded along with the milled asphalt at secondary conveyor discharge end 51. The operation of exhaust systems 60 and 80 will now be explained.

As illustrated in FIG. 1, cold planer 10 may break-up and remove asphalt with milling drum 32. During the operation of milling system 30, water nozzle 36 may spray water from water tank 26 onto milling drum 32 so as to cool milling drum 32 and its associated cutting tools 34. In addition to cooling milling system 30, the sprayed water from water nozzle 36 may also help control dust and fumes that may be generated as a byproduct of the milling process. The water may coalesce the dust particles and fumes with the milled material.

As milling drum 32 rotates towards primary conveyor 42, cutting tools 34 may heap the wet milled asphalt onto primary conveyor 42. The milled asphalt on primary conveyor 42 may then be transported to and thrust against weldment 48 of transition area 44. As the milled asphalt strikes weldment 48, it may break down further and fall onto secondary conveyor 50. Secondary conveyor 50 may transport the milled material to secondary conveyor discharge end 51, where the milled material may be off-loaded to transport vehicle 58.

Although water distributed via water nozzle 36 may help to control the amount of dust and fumes generated during the operation of cold planer 10, a significant amount of dust and fumes may still result. In particular, the operation of milling drum 32 and the crashing of the milled asphalt into weldment 48 are two operations of cold planer 10 that may result in significant amounts of dust and fumes despite the addition of water. Exhaust systems 60 and 80 may further assist in the control of dust and fumes generated during the operation of cold planer 10.

Ventilators 78 and 92 may create a depressed air pressure state within exhaust systems 60 and 80, such that polluted air may be drawn into inlet manifold 62, inlet extensions 66 and secondary inlet hoses 82 and routed to secondary conveyor housing 52. Secondary conveyor 50 may be housed by secondary conveyor housing 52 in such a way so as to prevent the egress of collected dust and fumes prior to the discharge of the same along with the milled asphalt at secondary conveyor discharge end 51. The length of secondary conveyor 50 and secondary conveyor housing 52 may provide ample time for the collected dust and fumes delivered by ventilator 78 to settle and coalesce into the wet milled asphalt being transported on secondary conveyor 50. Consequently, the dust and fumes collected by exhaust systems 60 and 80 may be discharged along with the milled asphalt material at secondary conveyor discharge end 51.

With the disclosed placement of inlet manifold 62, it may be more likely that dust and fumes generated at milling drum 32 are drawn into inlet manifold 62 rather than significantly larger fragments of milled asphalt. If larger fragments of milled asphalt were drawn into inlet manifold 62 and routed through exhaust system 60, such may incur damage to ventilator 78.

With the disclosed placement of inlet extensions 66, it may be more likely that dust and fumes generated at milling drum 32, that escape inlet manifold 62, may be drawn into inlet extensions 66. In this way, visibility of road surface 11 at the point of milling may be more closely and accurately monitored.

With the disclosed placement of secondary inlet hoses 82, it may be more likely that excess dust and fumes generated at weldment 48 are captured and routed to secondary conveyor housing 52. Consequently, visibility and working conditions at or near operator station 20 may be improved.

Given its simple design and constitution, exhaust systems 60 and 80 may be easily attached to many different types and models of cold planer 10. As rigid pipes 70 may be removably attached to the exterior of water tank 26, as opposed to running through water tank 26, exhaust systems 60 and 80 may be easily attached to or removed from cold planer 10. Specifically, older machines may be retrofitted with exhaust systems 60 or 80 if the exhaust-related benefits of such are desired. Regulatory standards may require that an older or current model of cold planer 10 be retrofitted with a system such as either exhaust system 60 or 80.

It will be apparent to those skilled in the art that various modifications and variations can be made to the disclosed exhaust systems without departing from the scope of the disclosure. Other embodiments of the exhaust systems will be apparent to those skilled in the art from consideration of the specification and practice of the exhaust systems disclosed herein. It is intended that the specification and examples be considered as exemplary only, with a true scope of the disclosure being indicated by the following claims and their equivalents.

What is claimed is:

1. An exhaust system for a cold planer, comprising:

an inlet manifold located above a material conveyor between a charge end and a discharge end of the material conveyor, the charge end being disposed adjacent a milling drum and the inlet manifold being located nearer the charge end relative to the discharge end and configured to receive dust and fumes generated by the milling drum;

at least one inlet passage extending from an end of the inlet manifold to a point that is gravitationally lower than the inlet manifold and located at a side of the material conveyor, the at least one inlet passage configured to receive dust and fumes generated by the milling drum; and a ventilator in fluid communication with the inlet manifold and the at least one inlet passage, the ventilator configured to draw the dust and fumes from the inlet manifold and the at least one inlet passage to the ventilator.

2. The exhaust system of claim 1, wherein the at least one inlet passage includes two inlet passages located at opposing sides of the material conveyor.

3. The exhaust system of claim 2, wherein the two inlet passages are in fluid communication with opposing ends of the inlet manifold, and further including at least one discharge passage extending from a connector of the inlet manifold and at least one of the two inlet passages to the ventilator.

4. The exhaust system of claim 3, wherein the at least one discharge passage includes two discharge passages in fluid communication with the two inlet passages at junctions of the two inlet passages and the opposing ends of the inlet manifold.

5. The exhaust system of claim 4, wherein the two discharge passages are spaced apart to accommodate a water tank therebetween.

6. The exhaust system of claim 4, wherein the two discharge passages converge to a single larger discharge passage.

7. The exhaust system of claim 6, wherein the single larger discharge passage is flexible.

8. The exhaust system of claim 1, wherein the ventilator is located at an end of the exhaust system opposite the inlet manifold.

9. The exhaust system of claim 1, wherein the ventilator is mounted upon, and configured to discharge into, a conveyor housing.

10. The exhaust system of claim 9, wherein the ventilator is located at a first half of a folding material conveyor.

11. The exhaust system of claim 1, wherein the inlet manifold and the at least one inlet passage are located inside a structural housing of the cold planer.

12. The exhaust system of claim 1, wherein the inlet manifold is located at about 300-800 mm downstream of the milling drum.

13. The exhaust system of claim 1, wherein the at least one inlet passage is located at about 300-800 mm downstream of the milling drum.

14. An exhaust system for a cold planer, comprising:

an inlet manifold located above a first material conveyor between a charge end and a discharge end of the material conveyor, the charge end being disposed adjacent a milling drum and the inlet manifold being located nearer the charge end relative to the discharge end and configured to receive dust and fumes generated by the milling drum;

at least one inlet passage located at a transition area between the first material conveyor and a second material conveyor, the at least one inlet passage configured to receive dust and fumes generated by impingement of milled material against a weldment member located above the second material conveyor in the transition area; and a ventilator in fluid communication with the inlet manifold and the at least one inlet passage, the ventilator located at a discharge end of the second material conveyor and configured to draw the dust and fumes from the inlet manifold and the at least one inlet passage to the ventilator.

15. The exhaust system of claim 14, wherein the at least one inlet passage includes two inlet passages located at opposing sides of the transition area.

16. The exhaust system of claim 15, wherein at least one of the two inlet passages is in fluid communication with the inlet manifold, and further including at least one discharge passage extending from the manifold to the ventilator.

17. The exhaust system of claim 16, wherein the at least one discharge passage includes two discharge passages in fluid communication with the two inlet passages at junctions of the two inlet passages and opposing ends of the inlet manifold.

18. The exhaust system of claim 17, wherein the two discharge passages are spaced apart to accommodate a water tank therebetween.

19. The exhaust system of claim 17, wherein the two discharge passages converge to at least one single larger discharge passage.

20. The exhaust system of claim 19, wherein the at least one single larger discharge passage is flexible.

21. The exhaust system of claim 14, wherein the ventilator is located at an end of the exhaust system opposite the inlet manifold.

22. The exhaust system of claim 14, wherein the ventilator is mounted upon, and configured to discharge into, a conveyor housing.

23. The exhaust system of claim 22, wherein the ventilator is located at a first half of a folding material conveyor.

24. The exhaust system of claim 14, wherein the inlet manifold and the at least one inlet passage are located inside a structural housing of the cold planer.

25. The exhaust system of claim 14, wherein the inlet manifold is located at about 300-800 mm downstream of the milling drum.

26. The exhaust system of claim 14, wherein the at least one inlet passage is located at about 300-800 mm upstream of the weldment member.

27. A cold planer, comprising:

a frame;

at least one traction device configured to support the frame;

an engine supported by the frame and configured to drive the at least one traction device to propel the cold planer;

a milling drum;

a first conveyor having a charge end located proximate the milling drum to receive the removed material, and a discharge end;

a second conveyor having a charge end located proximate the discharge end of the first material conveyor, and a discharge end;

a weldment member located above the second conveyor in a path of the removed material at a transition area of the first and second conveyors;

an inlet manifold located downstream of the milling drum and above the first conveyor, the inlet manifold being located nearer the charge end of the first conveyor relative to the discharge end of the first conveyor and configured to receive dust and fumes generated by the milling drum;

a first inlet passage located at a first side of the transition area between the first conveyor and the second conveyor, the first inlet passage configured to receive dust and fumes generated by impingement of roadway material against the weldment member;

a second inlet passage located at a second side of the transition area between the first conveyor and the second conveyor, the second inlet passage configured to receive dust and fumes generated by impingement of roadway material against the weldment member; and a ventilator located at the discharge end of the second material conveyor and configured to draw dust and fumes from the inlet manifold to the ventilator, the first inlet passage, and the second inlet passage, and to discharge the dust and fumes into material on the second conveyor.

* * * * *